US007729638B2

(12) United States Patent
Katahira et al.

(10) Patent No.: US 7,729,638 B2
(45) Date of Patent: Jun. 1, 2010

(54) IMAGE FORMING APPARATUS, CHARGER, AND IMAGE CARRIER UNIT

(75) Inventors: Masahiro Katahira, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 247 days.

(21) Appl. No.: 11/898,874

(22) Filed: Sep. 17, 2007

(65) Prior Publication Data

US 2008/0181666 A1 Jul. 31, 2008

(30) Foreign Application Priority Data

Jan. 29, 2007 (JP) ..... P2007-018213

(51) Int. Cl.
*G03G 15/02* (2006.01)

(52) U.S. Cl. ..... 399/168; 399/176

(58) Field of Classification Search ..... 399/100, 399/168, 170, 174, 175, 176, 350, 351
See application file for complete search history.

(56) References Cited

U.S. PATENT DOCUMENTS 5,576,805 A * 11/1996 Ishihara et al. ..... 399/176
6,374,073 B2 * 4/2002 Ozaki et al. ..... 399/176 X
6,389,255 B1 * 5/2002 Sawada et al. ..... 399/176
7,460,815 B2 * 12/2008 Kamoshida et al. ..... 399/176
7,539,443 B2 * 5/2009 Kamoshida et al. ..... 399/176

FOREIGN PATENT DOCUMENTS

| | | |
|---|---|---|
| JP | 7-104577 | 4/1995 |
| JP | 7-199599 | 8/1995 |
| JP | 7-261507 | 10/1995 |
| JP | 2003-140445 | 5/2003 |

* cited by examiner

*Primary Examiner*—Sandra L Brase
(74) *Attorney, Agent, or Firm*—Morgan, Lewis & Bockius LLP

(57) ABSTRACT

An image forming apparatus includes: an image carrier that rotates; and a charging member that is provided opposingly to the image carrier, and that charges a surface of the image carrier, wherein a discharge inhibitor that suppresses a discharge in an axial end portion is interposed in a portion where the charging member is opposed to the image carrier.

19 Claims, 16 Drawing Sheets

IMAGE FORMING APPARATUS, CHARGER, AND IMAGE CARRIER UNIT

CROSS-REFERENCE TO RELATED APPLICATIONS

This application is based on and claims priority under 35 USC 119 from Japanese Patent Application No. 2007-18213 filed on Jan. 29, 2007.

BACKGROUND

1. Technical Field

The present invention relates to am image forming apparatus, a charger, and an image carrier unit.

2. Related Art

In an image forming apparatus of the electrophotographic system, such as a copier, a printer, or a facsimile apparatus, conventionally, the surface of an image carrier is charged by a charger. As the charger, a charger having a charging member such as a charging roll which is placed in contact with or in close proximity to the image carrier is known. In a charging roll, discharging is conducted in a gap or a wedge-like space between the image carrier and the charging roll, thereby performing charging.

SUMMARY

According to an aspect of the invention, there is provided an image forming apparatus including: an image carrier that rotates (a rotatable image carrier); a charging member that is provided opposingly to the image carrier, and that charges a surface of the image carrier; and a discharge inhibitor that suppresses a discharge in an axial end portion and is interposed in a portion where the charging member is opposed to the image carrier.

BRIEF DESCRIPTION OF THE DRAWINGS

Exemplary embodiments of the present invention will be described in detail based on the following figures, wherein:

FIG. 3A is a diagram illustrating main portions of FIG. 2, and FIG. 3B is a diagram illustrating length relationships;

FIG. 4A is a diagram illustrating main portions corresponding to FIG. 3A of Example 1, FIG. 4B is a side view of the image-carrier cleaning member, and FIG. 4C is a front view of the image-carrier cleaning member;

FIG. 5A is a side view of the image-carrier cleaning member corresponding to FIG. 4B of Example 2, and FIG. 5B is a front view of the image-carrier cleaning member corresponding to FIG. 4C of Example 2;

FIG. 6A is a side view of the image-carrier cleaning member corresponding to FIG. 5A of Example 3, FIG. 6B is a front view of the image-carrier cleaning member corresponding to FIG. 5B of Example 3, FIG. 6C is a diagram of measurement of dimensions of a support member in Example 4, and FIG. 6D is a diagram of measurement of dimensions of the support member in Example 3;

FIG. 16A is a diagram illustrating length relationships among components, FIG. 16B is a side view of an image-carrier cleaning member used in the experimental example, and FIG. 16C is a front view of the image-carrier cleaning member used in the experimental example.

DESCRIPTION OF REFERENCE NUMERALS AND SIGNS

Figure 1:
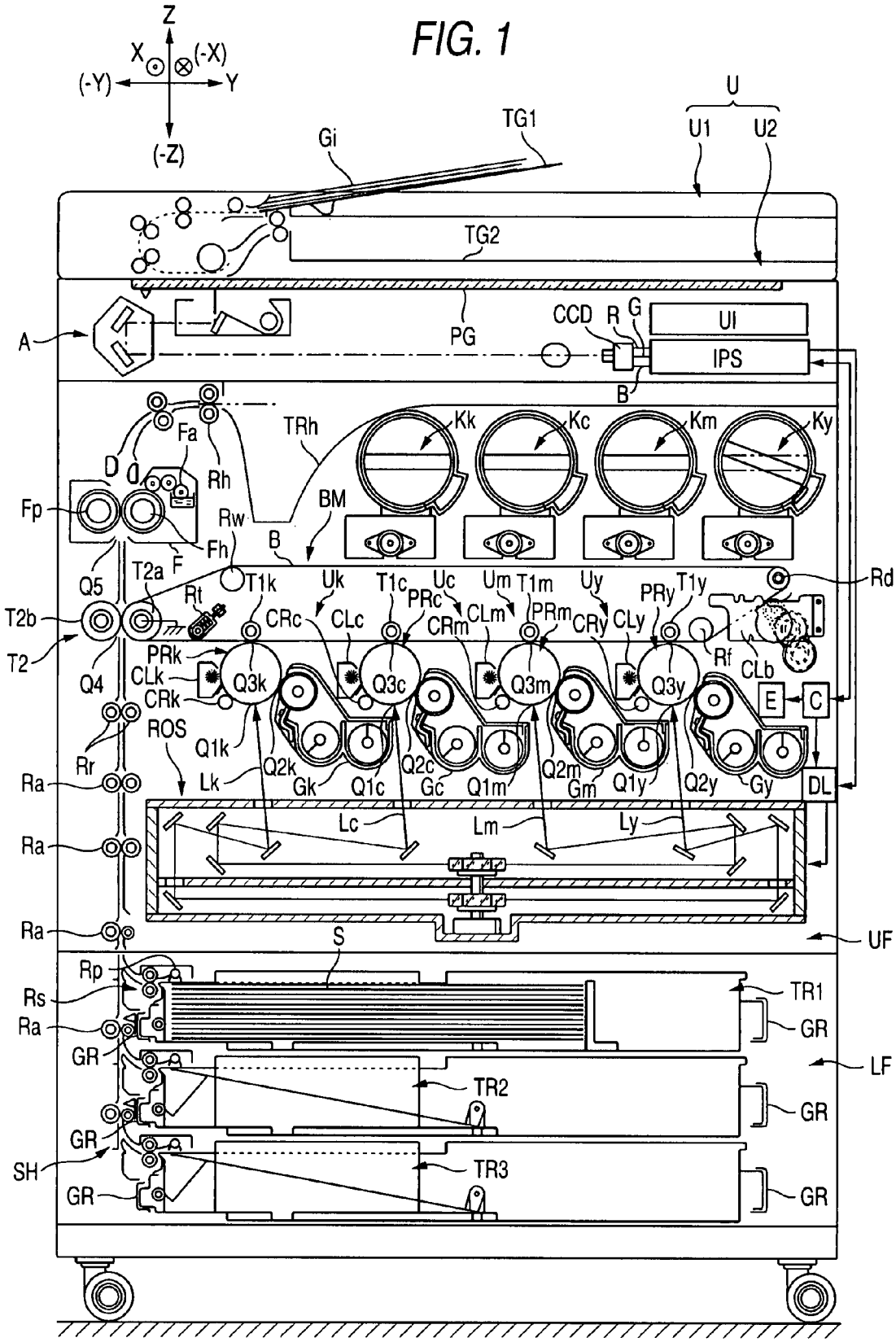
FIG. 1 is a diagram illustrating the whole of an image forming apparatus of Example 1 of the invention.

1 . . . charging member,
20, 20' . . . cleaning container,
24, 24', 27, 27', 27" . . . image-carrier cleaning member,
24, 29 . . . plate-like member,
26 . . . residual-transporting member,
28, 28" . . . support member,
28*a*" . . . flat portion,
29*a* . . . urging member,
31, 41 . . . charger cleaning member,
51 . . . end-portion transporting member,
52 . . . regulating member,
CLy, CLm, CLc, CLk . . . image-carrier cleaner,
CRy, CRm, CRc, CRk . . . charger,
GRy, GRm, GRc, GRk . . . developing agent carrier,
Gy, Gm, Gc, Gk . . . developer,
Lj1, Lj2, LJ1', LJ2' . . . free length,
PRy, PRm, PRc, PRk . . . image carrier,
U . . . image forming apparatus.

DETAILED DESCRIPTION

Next, examples which are specific examples of embodiments of the invention will be described with reference to the accompanying drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "x" is written in "○" indicates the arrow which is directed from the front of the sheet to the rear.

In the following description with reference to the drawings, illustration of members other than those which are necessary in description are suitably omitted for the sake of easy understanding.

Example 1

FIG. 1 is a diagram illustrating the whole of an image forming apparatus of Example 1 of the invention.

Referring to FIG. 1, the image forming apparatus U includes: an automatic document feeder U1; and an image forming apparatus body U2 which supports the feeder, and which has a transparent document reading surface PG at the upper end.

The automatic document feeder U1 has: a document supplying portion TG1 in which plural documents Gi to be copied are stacked and housed; and a document discharging portion TG2 onto which the documents Gi that are supplied from the document supplying portion TG1, and that are transported while being passed through a document reading station on the document reading surface PG are discharged.

The image forming apparatus body U2 has an operation portion U1 into which the user inputs an operation command signal such as start of an image forming operation, an exposing optical system A, etc.

Reflection light from a document which is transported on the document reading surface PG in the image forming apparatus body U2, or that which is manually placed on the document reading surface PG impinges on a solid-state image pickup device CCD through the exposing optical system A to be converted into electric signals of R (red), G (green), and B (blue).

An image information converting portion IPS converts the RGB electric signals supplied from the solid-state image pickup device CCD, into image information of K (black), Y (yellow), M (magenta), and C (cyan), temporarily stores the image information, and at a predetermined timing supplies the image information as image information for forming a latent image to a latent image formation driving circuit DL.

In the case that the document image is a monochromatic image, image information of only K (black) is supplied to the latent image formation driving circuit DL.

The latent image formation driving circuit DL has driving circuits (not shown) for respective colors, or Y, M, C, and K, and at a predetermined timing supplies laser driving signals corresponding to the input image information, to latent-image writing laser diodes (not shown) for the respective colors of a latent-image forming device ROS.

Figure 2:
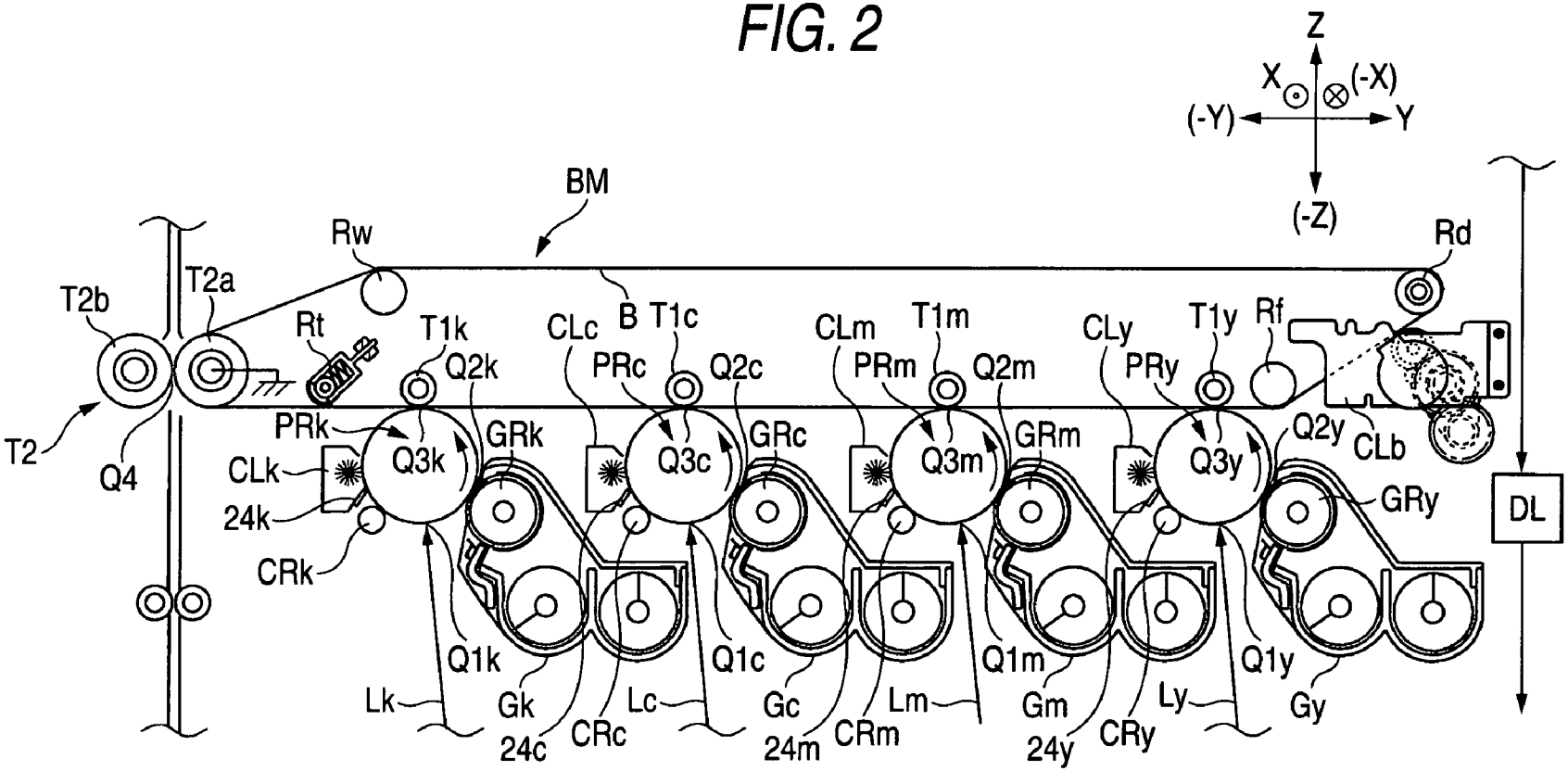
FIG. 2 is an enlarged diagram of main portions of the image forming apparatus of Example 1.

FIG. 2 is an enlarged diagram of main portions of the image forming apparatus of Example 1.

Visible-image forming devices Uy, Um, Uc, Uk which are arranged above the latent-image forming device ROS form toner images of the respective colors or Y (yellow), M (magenta), C (cyan), and K (black), respectively.

Laser beams Ly, Lm, Lc, Lk which are emitted from the laser diodes of the latent-image forming device ROS, and which are examples latent-image writing light of Y, M, C, and K impinge on image carriers PRy, PRm, PRc, PRk which rotate, respectively.

The visible-image forming device Uy for Y has the image carrier PRy which rotates, a charger CRy, a developer Gy, a transfer device T1*y*, and an image-carrier cleaner CLy. In Example 1, the developer Gy is configured by a developer unit which is attachable to and detachable from the image forming apparatus U, and the image carrier PRy, the charger CRy, and the image-carrier cleaner CLy are configured by an image carrier unit which is integrally attachable to and detachable from the image forming apparatus U. Namely, the visible-image forming device Uy in Example 1 is configured by the developer unit, the image carrier unit, the transfer device T1*y*, etc.

The visible-image forming devices Um, Uc, Uk are configured in a similar manner as the visible-image forming device Uy.

Referring to FIGS. 1 and 2, the image carriers PRy, PRm, PRc, PRk are charged by the respective chargers CRy, CRm, CRc, CRk, and, at image writing stations Q1*y*, Q1*m*, Q1*c*, Q1*k*, electrostatic latent images are formed in their surfaces by the laser beams Ly, Lm, Lc, Lk. In developing regions Q2*y*, Q2*m*, Q2*c*, Q2*k*, the electrostatic latent images in the surfaces of the image carriers PRy, PRm, PRc, PRk are developed into toner images by developing agents held by developing rolls GRy, GRm, GRc, GRk which are examples of developing agent carriers of the developers Gy, Gm, Gc, Gk.

The developed toner images are transported to primary transferring regions Q3*y*, Q3*m*, Q3*c*, Q3*k* which are contacted with an intermediate transfer belt B that is an example of an intermediate transferring member. At a predetermined timing, a power source circuit E which is controlled by a controller C applies a primary transfer voltage in which the polarity is opposite to the charging polarity of the toner, to primary transfer devices T1*y*, T1*m*, T1*c*, T1*k* placed on the rear face side of the intermediate transfer belt B in the primary transferring regions Q3*y*, Q3*m*, Q3*c*, Q3*k*.

The toner images on the image carriers PRy to PRk are primarily transferred to the intermediate transfer belt B by the primary transfer devices T1*y*, T1*m*, T1*c*, T1*k*. The toners remaining on the surfaces of the image carriers PRy, PRm, PRc, PRk after the primary transfer are cleaned by the image-carrier cleaners CLy, CLm, CLc, CLk. The surfaces of the image carriers PRy, PRm, PRc, PRk which have been cleaned are again charged by the chargers CRy, CRm, CRc, CRk.

A belt module BM which is an example of an intermediate transferring device that is vertically movable and forward extractable is placed above the image carriers PRy to PRk. The belt module BM has: the intermediate transfer belt B which is an example of the intermediate transferring member; belt supporting rolls (Rd, Rt, Rw, Rf, T2*a*) which are examples of an intermediate-transferring member support member including a belt driving roll Rd which is an example of an intermediate-transferring member driving member, a tension roll Rt which is an example of an intermediate-transferring member stretching member, a walking roll Rw which is an example of a meandering preventing member, an idler roll (free roll) Rf which is an example of a driven roll, and a backup roll T2*a* which is an example of a secondary-transfer region opposing member; and the primary transfer devices T1*y*, T1*m*, T1*c*, T1*k*. The intermediate transfer belt B is supported in a rotary movable manner by the belt supporting rolls (Rd, Rt, Rw, Rf, T2*a*).

A second transfer roll T2*b* which is an example of a secondary transfer member is placed while opposing the surface of the intermediate transfer belt B contacted with the backup roll T2*a*. A secondary transfer device T2 is configured by the rolls T2*a*, T2*b*. A secondary transferring region Q4 is formed in a region where the secondary transfer device T2*b* and the intermediate transfer belt B are opposed to each other.

The single- or multi-color toner images which are sequentially stackingly transferred onto the intermediate transfer belt B by the transfer devices T1*y*, T1*m*, T1*c*, T1*k* in the primary transferring regions Q3*y*, Q3*m*, Q3*c*, Q3*k* are transported to the secondary transferring region Q4.

Three pairs of right and left guide rails GR, GR which are examples of a guiding member that supports sheet feeding trays TR1 to TR3 so as to be movable in the front and rear directions (the X-axis directions) are disposed below the latent-image forming device ROS. Recording sheets S which are examples of media housed in the sheet feeding trays TR1 to TR3 are taken out by a pickup roll Rp which is an example of a medium taking out member, and separated one by one by a separating roll Rs which is an example a medium separating member. Then, the recording sheet is transported by plural transporting rolls Ra which are examples of a medium transporting member, along a sheet transport path SH which is an example a medium transport path, and sent to a registration roll Rr which is an example a transfer-region transportation timing adjusting member disposed on the upstream side of the secondary transferring region Q4. A sheet transporting device (SH+Ra+Rr) is configured by the sheet transport path SH, the transporting rolls Ra, the registration roll Rr, etc.

The registration roll Rr transports the recording sheet S to the secondary transferring region Q4 in timing with the transportation of the toner image formed on the intermediate transfer belt B to the secondary transferring region Q4. When the recording sheet S is passed through the secondary transferring region Q4, the backup roll T2*a* is grounded, and the power source circuit E which is controlled by the controller C applies a secondary transfer voltage which is opposite to the charging polarity of the toner, to the secondary transfer device T2*b* at a predetermined timing. At this time, the color toner image on the intermediate transfer belt B is transferred to the recording sheet S by the secondary transfer device T2.

After the secondary transfer, the intermediate transfer belt B is cleaned by a belt cleaner CLb which is an example of an intermediate-transferring member cleaner.

The recording sheet S onto which the toner image has been secondarily transferred is transported to a fixing region Q5 which is a press contact region between a heating roll Fh that is an example of a heating fixing member of a fixing device F, and a pressuring roll Fp that is an example of a pressuring fixing member, and subjected to heating fixation when passed through the fixing region. The recording sheet S which has undergone heating fixation is discharged to a discharge tray TRh which is an example of a medium discharging portion, from a discharging roller Rh which is an example of a medium discharging member.

A release agent which improves the property of releasing of the recording sheet S from the heating roll is applied to the surface of the heating roll Fh by a release-agent applying device Fa.

Developing agent cartridges Ky, Km, Kc, Kk which are examples of developing agent replenishment containers respectively housing developing agents of Y (yellow), M (magenta), C (cyan), and K (black) are arranged above the belt module BM. The developing agents housed in the developing agent cartridges Ky, Km, Kc, Kk are replenished to the developers Gy, Gm, Gc, Gk in accordance with consumptions of the developing agents of the developers Gy, Gm, Gc, Gk, through developing agent replenishment paths which are not shown. In Example 1, each developing agent is configured by a two-component developing agent containing a magnetic carrier, and a toner to which an external additive is added.

Referring to FIG. 1, the image forming apparatus U has an upper frame UF and a lower frame LF. The upper frame UF supports the latent-image forming device ROS and the components which are placed above the latent-image forming device ROS, i.e., the image carriers PRy, PRm, PRc, PRk, the developers Gy, Gm, Gc, Gk, the belt module BM, etc.

The lower frame LF supports the guide rails GR supporting the sheet feeding trays TR1 to TR3, the sheet feeding members which feed sheets from the trays TR1 to TR3, i.e., the pickup roll Rp, the separating roll Rs, the sheet transporting rolls Ra, etc.

(Description of Components of Visible-Image Forming Device)

Figure 3A:
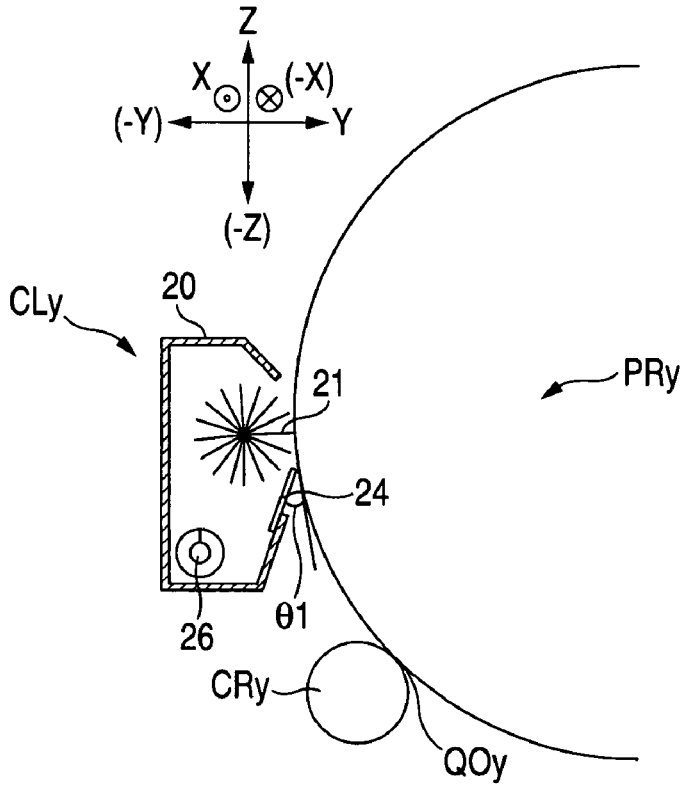
FIGS. 3A and 3B are diagrams illustrating an image-carrier cleaning member, an image carrier, and a charging member in the image forming apparatus of Example 1 of the invention.
Figure 3B:
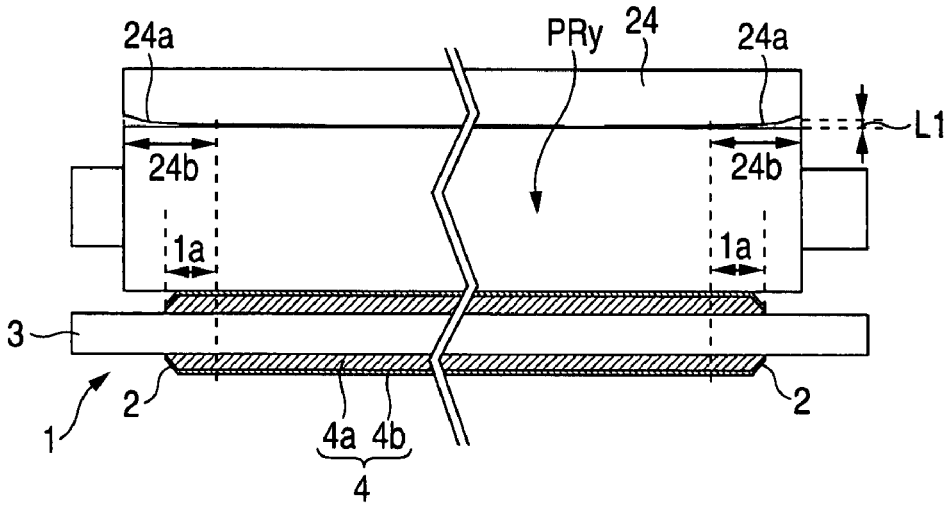

FIGS. 3A and 3B are diagrams illustrating the image-carrier cleaning member, the image carrier, and the charging member in the image forming apparatus of Example 1 of the invention, FIG. 3A is a diagram illustrating main portions of FIG. 2, and FIG. 3B is a diagram illustrating length relationships.

Next, the chargers CRy, CRm, CRc, CRk and image-carrier cleaners CLy, CLm, CLc, CLk which constitute the visible-image forming devices Uy, Um, Uc, Uk in Example 1 of the invention will be described. Since the components for the respective colors are configured in the same manner, only the components for Y color will be described, and detailed description of the components for the other colors will be omitted.

(Description of Charger)

Referring to FIGS. 2 and 3, the charger CRy in Example 1 has a charging roll 1 which is an example of the charging member that is contacted with the surface of the image carrier PRy to be drivenly rotated. Referring to FIGS. 3A and 3B, as the charging roll 1 in Example 1, a charging roll 1 which has an outer diameter of 12 mm and an axial length of 320 mm, and in which a narrowed or taper portion 2 of 1 mm is formed by 45 degrees in each of both axial end portions can be used. The charging roll 1 has a metal core member 3 serving as a rotation shaft and having a diameter of 8 mm, and an elastic rubber layer 4 disposed on the outer circumference of the core member 3 and having a thickness of 2 mm. The elastic rubber layer 4 is configured by an elastic layer 4*a*, and a surface layer 4*b*. As the elastic layer 4*a*, for example, epichlorohydrin rubber in which an ion conductive agent is dispersed is used. As the surface layer 4*b*, for example, a polyester or polyamide resin having a thickness of 3 to 6 μm is used.

A charging voltage in which an AC voltage is superimposed on a DC voltage is applied to the charging roll 1. The charging roll is controlled by a constant current. The surface of the image carrier PRy is charged by discharging in a wedge-like space along the rotation direction of the image carrier PRy, i.e., a charging region Q0*y*. As the image carrier PRy in Example 1, for example, a so-called organic photosensitive member can be used. A photosensitive member in which a subbing layer having an axial length of 355 mm is disposed on a conductive support member made of aluminum and having an axial length of 370 mm, a photosensitive layer consisting of a charge generating layer and a charge transporting layer is disposed on the surface of the layer, and a protective layer is disposed in the outermost layer is used. For example, the thickness of the charge transporting layer is 17 to 19 μm, and that of the protective layer is 7 to 8 μm.

(Description of Image-Carrier Cleaner)

Referring to FIGS. 3A and 3B, the image-carrier cleaner CLy in Example 1 has a housing 20 which is an example of a cleaning container. In the housing 20, a cleaning brush 21 which is an example of a rotary cleaning member opposed to the image carrier PRy is rotatably supported.

A cleaning blade 24 which is an example of an image carrier cleaning member that scrapes off a residual toner from the surface of the image carrier PRy is placed on the downstream side of the cleaning brush 21 in the rotation direction of the image carrier PRy. The cleaning blade 24 in Example 1 is configured by a plate-like member, and may be configured by urethane rubber. A blade having a width of 324 mm in the axial direction of the image carrier PRy, a length of 8 mm, and a thickness of 2 mm may be used. Referring to FIG. 3B, in each of the both end portions of the cleaning blade 24 in Example 1, a passing allowance portion 24*a* in which the outer end is formed to be shorter by a length of L1 than a middle portion is disposed. In Example 1, the length L1 is set to 0.2 mm.

Referring to FIG. 3A, the cleaning blade 24 is contacted with the image carrier PRy at a contact angle of θ1 to the tangential direction. In Example 1, the angle θ1 is set to 21 to 25 degrees. The cleaning blade 24 is designed so as to bite by a predetermined amount. In Example 1, it is set so that the biting amount in the middle portion is 1.2 mm and that in the end portions is 1.0 mm. That is, in amount by which the cleaning blade 24 protrudes or enters toward the image carrier PRy, the end portions are set to be smaller than the middle portion.

The residuals which have been recovered by the cleaning brush 21, such as the toner, the external additive, paper dust, and discharge products, and those which are scraped off by the cleaning blade 24 are transported by a waste-toner transport auger 26 which is an example of a residual-transporting member, and recovered into a recovery container (not shown) for residual disposal.

The image-carrier cleaner CLy in Example 1 is configured by the above-described components denoted by the reference numerals 21 to 26.

Function of Example 1

In the image forming apparatus U of Example 1 including the above-described constituents, residuals remaining on the surfaces of the image carriers PRy to PRk after the toner images have been transferred to the intermediate transfer belt B in the primary transferring regions Q3*y*, Q3*m*, Q3*c*, Q3*k* are cleaned by the image-carrier cleaner CLy. In this case, the passing allowance portion 24*a* is disposed in each of the end portions of the cleaning blade 24. Because of the reduced biting amount in the end portions due to the passing allowance portions 24*a*, a part of the residuals is passed through the cleaning blade 24 in the end portions. A high-resistance residual which has been passed through the cleaning blade 24, such as the toner and the external additive, i.e., a discharge inhibitor is passed through passing allowance areas 24*b* of the cleaning blade 24 corresponding to the passing allowance portions 24*a*, and adheres to discharge-inhibitor giving areas 1*a* in both end portions of the charging roll 1 on the downstream side of the rotation direction of the image carrier. Therefore, the resistances of the end portions and taper portions 2 of the charging roll 1 are increased, and discharging in the end portions is reduced. In accordance with the reduction of end discharging, also wears of the image carriers PRy to PRk due to discharge, and occurrences of local discharge and ground leakage are reduced.

In the image forming apparatus of Example 1, as the toner contained in the developing agent, a toner which is produced by an arbitrary production method can be used. A pulverized toner which is conventionally used, and which is produced by the pulverizing method, or a polymerized toner which is produced by the emulsion polymerization method can be used. As a polymerized toner which is produced by the emulsion polymerization method, for example, fine particles having an outer diameter of 6 μm in which a coloring agent and wax are internally added to a binder resin such as polyester or styrene acryl can be used. In order to improve the charging and transferring properties, an external additive of inorganic fine particles such as silica ($SiO_2$), cerium oxide ($CeO_2$), or titania ($TiO_2$) having a mean particle diameter of 5 to 200 nm may be externally added to the toner. As compared with a conventional toner produced by the pulverizing method, such a polymerized toner or an external additive has a smaller outer diameter, and hence is easily passed through the cleaning blade 24. When a transfer residual toner is scraped by the cleaning blade 24, the external additive is separated from the toner, and easily passed through the cleaning blade 24. When a developing agent containing a polymerized toner and an external additive is used, namely, the discharge inhibitor is easily passed as compared with the case of a pulverized toner, and the resistance of the end portions of the charging roll 1 is efficiently increased.

Example 2

Next, Example 2 of the invention will be described. In the description of Example 2, the components corresponding to those of Example 1 are denoted by the same reference numerals, and their detailed description will be omitted.

Example 2 is configured in the same manner as Example 1 except the following points.

Figure 4A:
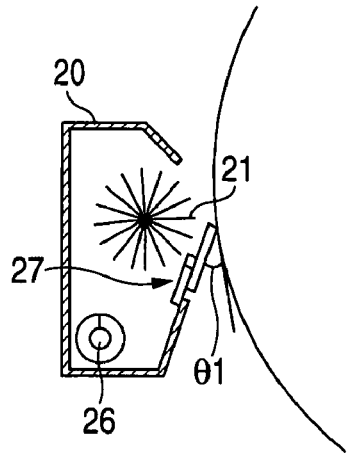
FIGS. 4A, 4B and 4C are diagrams illustrating an image-carrier cleaning member in Example 2.
Figure 4B:
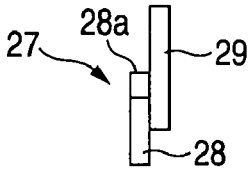
Figure 4C:
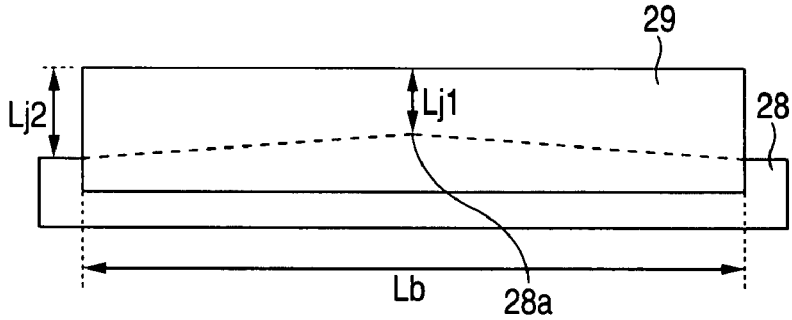

FIGS. 4A, 4B and 4C are diagrams illustrating an image-carrier cleaning member in Example 2, FIG. 4A is a diagram illustrating main portions corresponding to FIG. 3A of Example 1, FIG. 4B is a side view of the image-carrier cleaning member, and FIG. 4C is a front view of the image-carrier cleaning member.

Referring to FIGS. 4A, 4B and 4C, in place of the cleaning blade 24 which is an example of the image-carrier cleaning member in Example 1, the image-carrier cleaning member 27 in Example 2 has: a support member 28 which is supported by the housing 20; and a cleaning blade 29 which is an example of a plate-like member that is supported by the support member 28, and that is contacted with the surface of the image carrier PRy to PRk to clean it.

The support member 28 in Example 2 is configured by, for example, a steel plate having a thickness of 2 mm. Referring to FIG. 4C, the support member 28 in Example 2 is formed into a chevron shape in which a middle portion 28*a* protrudes toward the image carrier PRy to PRk, and the protrusion amount is smaller as more advancing from the middle portion 28*a* toward the both ends. In the support member 28, namely, with respect to the length extending toward the image carrier PRy to PRk, the both end portions are shorter than the middle portion 28*a*. In the cleaning blade 29 supported by the support member 28, with respect to a free length Lj which is a length from a tip end of the support member 28 to that of the cleaning blade 29, therefore, the free length Lj2 of the end portions is longer than the free length Lj1 of the middle portion.

The cleaning blade 29 is configured by urethane rubber which is an example of elastic rubber having, for example, a thickness of 2 mm and an axial length Lb of 324 mm. The free length Lj1 of the middle portion is set to 8 mm, and the free length Lj2 of the end portions is set to 9 mm. In the cleaning blade 29, therefore, the contact pressures in the end portions are lower than the contact pressure in the middle portion. For example, the contact pressure of the cleaning blade 29 with respect to the image carrier PRy to PRk is set to 40 mN/mm in terms of linear pressure in the middle portion, and to 30 mN/mm in the end portions.

Function of Example 2

In the thus configured image forming apparatus of Example 2, the contact pressure is lower as more advancing toward the both ends, and a part of residuals is passed more easily through the cleaning blade 29. In the same manner as Example 1, namely, a discharge inhibitor which has been passed adheres to the discharge-inhibitor giving areas 1*a* in the end portions of the charging roll 1, and the resistance of the end portions of the charging roll 1 is increased.

Example 3

Next, Example 3 of the invention will be described. In the description of Example 3, the components corresponding to those of Examples 1 and 2 are denoted by the same reference numerals, and their detailed description will be omitted.

Example 3 is configured in the same manner as Examples 1 and 2 except the following points.

Figure 5A:
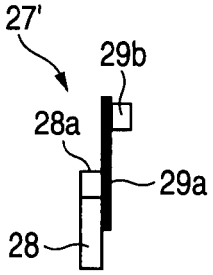
FIGS. 5A and 5B are diagrams illustrating an image-carrier cleaning member in Example 3.
Figure 5B:
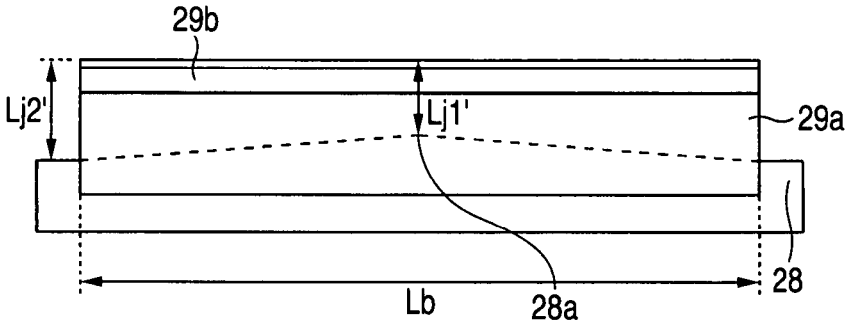

FIGS. 5A and 5B are diagrams illustrating an image-carrier cleaning member in Example 3, FIG. 5A is a side view of the image-carrier cleaning member corresponding to FIG. 4B of Example 2, and FIG. 5B is a front view of the image-carrier cleaning member corresponding to FIG. 4C of Example 2.

Referring to FIGS. 5A and 5B, the image-carrier cleaning member 27' in Example 3 has: the support member 28 which is configured in the same manner as that in Example 2; a plate-like urging member 29*a* in which a basal end portion is supported by the support member 28; and a contact member 29*b* which is supported by a tip end portion of the urging member 29*a*, and which is contacted with the surface of the image carrier PRy to PRk to clean it.

The urging member 29*a* can be configured by, for example, a plate spring-like member made of a metal, or produced by SUS304 having a thickness of about 80 μm, magnesium Alloy or phosphor bronze having a thickness of about 80 to about 100 mm, polyethylene terephthalate, polycarbonate, polyamide, polyamide-imide, Polyetherimide, polyetheretherkethon, polyoxymethylen having a thickness of about 200 mm to about 500 mm. The contact member 29*b* is configured by, for example, polyurethane rubber having a thickness of 1.2 mm, a width of 5 mm, and an axial length of 324 mm. In Example 3, the contact pressure is set to 35 mN/mm in the axial middle portion, and to 27 mN/mm in the end portions.

Function of Example 3

In the thus configured image forming apparatus U of Example 3, a free length Lj1' of the middle portion of the urging member 29*a* which is supported by the chevron-shaped support member 28 is shorter than free length Lj2' of the end portions. In the end portions, therefore, a part of residuals is passed easily through the cleaning blade 29. In the same manner as Example 1, namely, a discharge inhibitor which has been passed adheres to the discharge-inhibitor giving areas 1*a* in the end portions of the charging roll 1, and the resistance of the end portions of the charging roll 1 is increased.

In the image forming apparatus U of Example 3, in the case where the urging member 29*a* is produced by a metal plate spring, a so-called permanent set of rubber is suppressed as compared with the case where, as in Example 2, the whole is configured by the cleaning blade 29 made of rubber, and variation of the butting pressure of the contact member 29*b* against the image carrier PRy to PRk is reduced. In the case where the urging member 29*a* is produced by a metal plate spring, a phenomenon that peeling is caused to occur by friction between rubber and the surface of the image carrier PRy to PRk is suppressed as compared with the case where, as in Example 2, the whole is configured by the cleaning blade 29 made of rubber.

Example 4

Next, Example 4 of the invention will be described. In the description of Example 4, the components corresponding to those of Examples 1 to 3 are denoted by the same reference numerals, and their detailed description will be omitted.

Example 4 is configured in the same manner as Examples 1 to 3 except the following points.

Figure 6A:
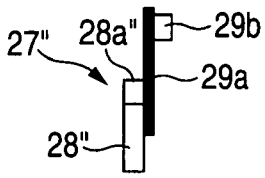
FIGS. 6A, 6B, 6C and 6D are diagrams illustrating an image-carrier cleaning member in Example 4.
Figure 6B:
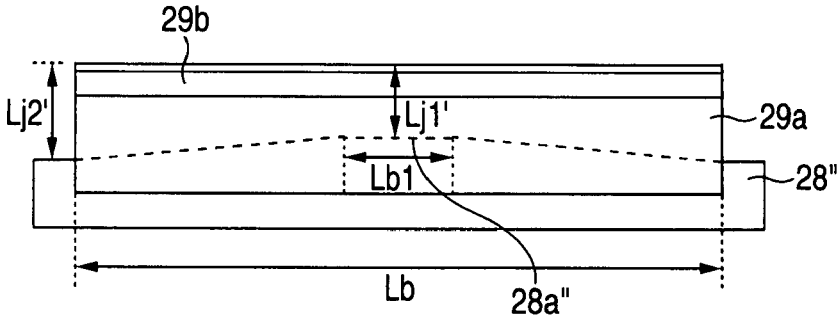
Figure 6C:
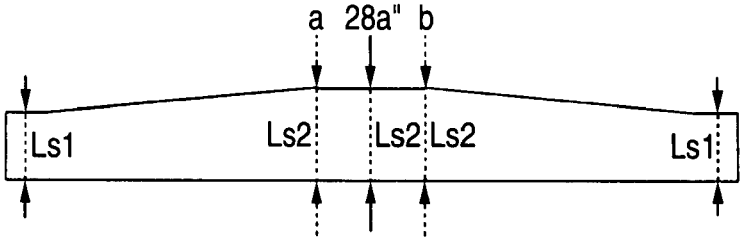
Figure 6D:
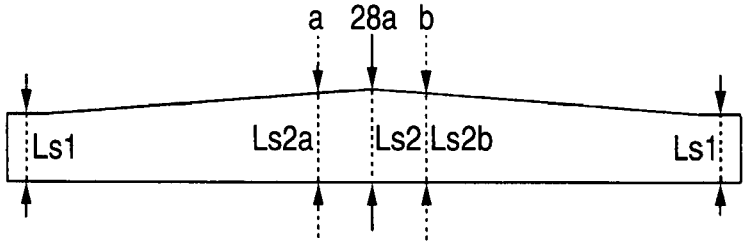

FIGS. 6A, 6B, 6C and 6D are diagrams illustrating an image-carrier cleaning member in Example 4, FIG. 6A is a side view of the image-carrier cleaning member corresponding to FIG. 5A of Example 3, FIG. 6B is a front view of the image-carrier cleaning member corresponding to FIG. 5B of Example 3, FIG. 6C is a diagram of measurement of dimensions of a support member in Example 4, and FIG. 6D is a diagram of measurement of dimensions of the support member in Example 3.

Referring to FIGS. 6A, 6B, 6C and 6D, the image-carrier cleaning member 27" in Example 4 has: a support member 28" which is different from the members in Examples 2 and 3; and the urging member 29*a* and contact member 29*b* which are configured in the same manner as those in Example 3.

Referring to FIGS. 6A, 6B, 6C and 6D, the support member 28" in Example 4 is formed into a trapezoidal shape in which the apex portion of the chevron-shaped support member 28 in Examples 2 and 3 is cut away. In the cut-away apex portion, a flat portion 28*a*" serving as a middle portion is formed. In Example 4, for example, the width Lb1 of the flat portion 28*a*" is set to 16 mm.

Function of Example 4

In the thus configured image forming apparatus U of Example 4, the free length Lj1' of the middle portion of the urging member 29*a* which is supported by the trapezoidal support member 28" is shorter than the free length Lj2' of the end portions. In the end portions, therefore, a part of residuals is passed easily through the cleaning blade 29. In the same manner as Example 1, namely, a discharge inhibitor which has been passed adheres to the discharge-inhibitor giving areas 1*a* in the end portions of the charging roll 1, and the resistance of the end portions of the charging roll 1 is increased.

Referring to FIG. 6D, in the case of the support member 28 in Example 3, the middle portion 28*a* is pointed. During dimension measurement, when a check position is deviated, therefore, measurement is performed not at the middle portion 28*a* but at positions a, b, and hence measured widths Ls2*a*, Ls2*b* are different from the width Ls2 of the middle portion 28*a*, with the result that dimension measurement cannot be sometimes correctly performed. By contrast, referring to FIG. 6C, in dimension measurement of the flat portion 28*a*" in a step of checking the support member 28" in the image forming apparatus U of Example 4, the width Ls2 of the middle portion 28*a*" of the support member 28" can be measured easily and correctly even when the measurement position is slightly deviated.

Example 5

Next, Example 5 of the invention will be described. In the description of Example 5, the components corresponding to those of Example 1 are denoted by the same reference numerals, and their detailed description will be omitted.

Example 5 is configured in the same manner as Example 1 except the following points.

Figure 7:
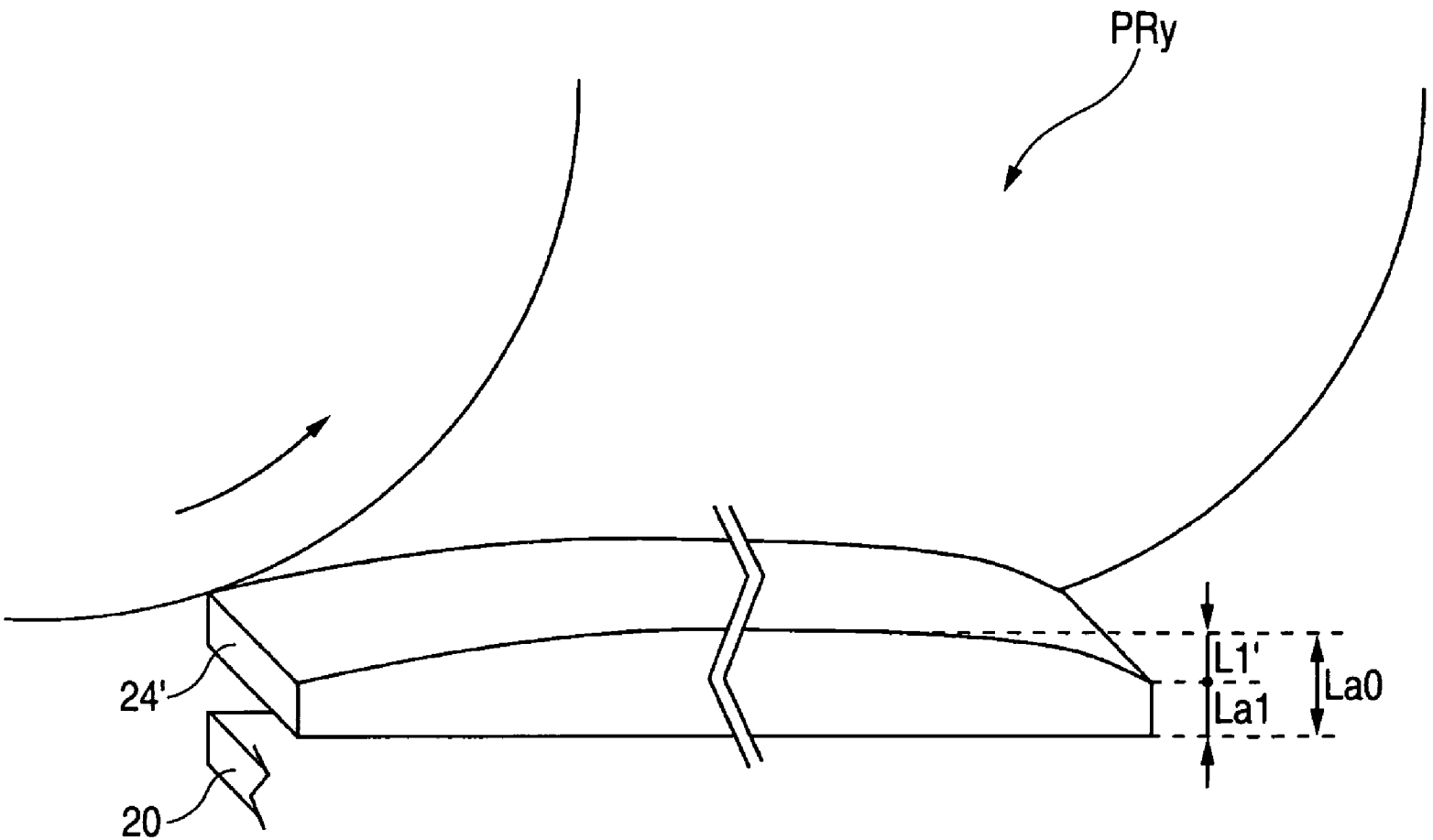
FIG. 7 is a perspective diagram of an image-carrier cleaning member in Example 5 of the invention.

FIG. 7 is a perspective diagram of an image-carrier cleaning member in Example 5 of the invention.

Referring to FIG. 7, in the image forming apparatus U of Example 5 of the invention, as compared with the cleaning blade 24 in Example 1, with respect to the length of a cleaning blade 24' which is an example of the image-carrier cleaning member in Example 5, extending toward the image carrier PRy, the middle portion is equal to the both end portions. In the cleaning blade 24' in Example 5, with respect to the thickness of the cleaning blade 24', the middle portion is different by a length L1' from passing allowance portions 24*a*' in the end portions. In Example 5, the thickness La0 of the middle portion is set to 2.0 mm, and the thickness La1 of the both ends of the passing allowance portions 24*a*' is set to 1.9 mm. Namely, the length L1' is set to 0.1 mm.

Function of Example 5

In the thus configured image forming apparatus U of Example 5, the thickness of the passing allowance portions 24*a*' in the end portions of the cleaning blade 24' is smaller than that of the middle portion. Therefore, the contact pressure at which the cleaning blade is contacted to the image carrier PRy is reduced, so that the discharge inhibitor such as the toner and the external additive is passed through the blade. The discharge inhibitor which has been passed adheres to the discharge-inhibitor giving areas 1*a* of the charging roll 1, and the resistance is increased.

Example 6

Next, Example 6 of the invention will be described. In the description of Example 6, the components corresponding to those of Example 1 are denoted by the same reference numerals, and their detailed description will be omitted.

Example 6 is configured in the same manner as Example 1 except the following points.

Figure 8:
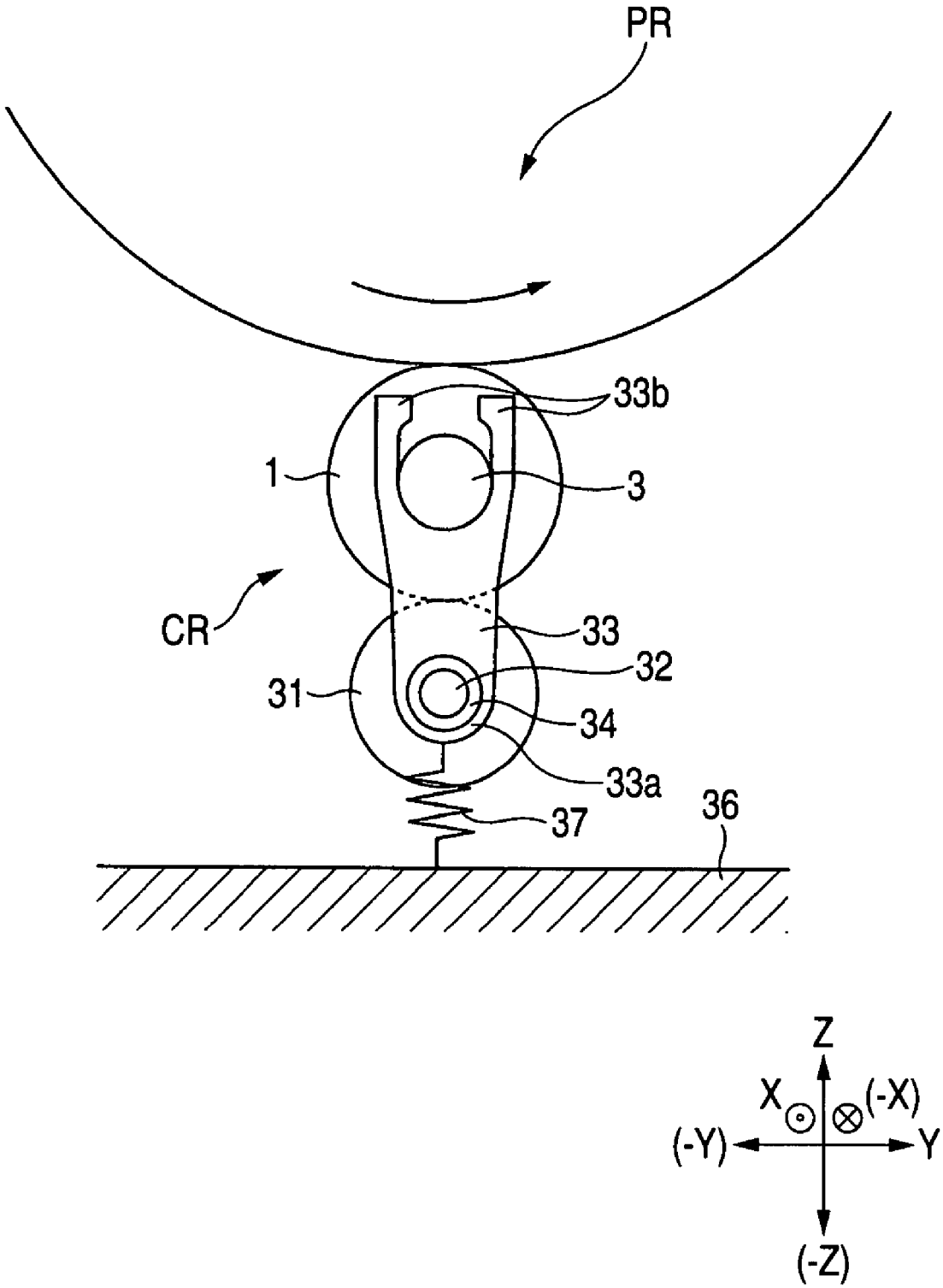
FIG. 8 is an enlarged diagram of main portions of a charger portion of the image forming apparatus of Example 6 of the invention.

FIG. 8 is an enlarged diagram of main portions of a charger portion of the image forming apparatus of Example 6 of the invention.

Figure 9:
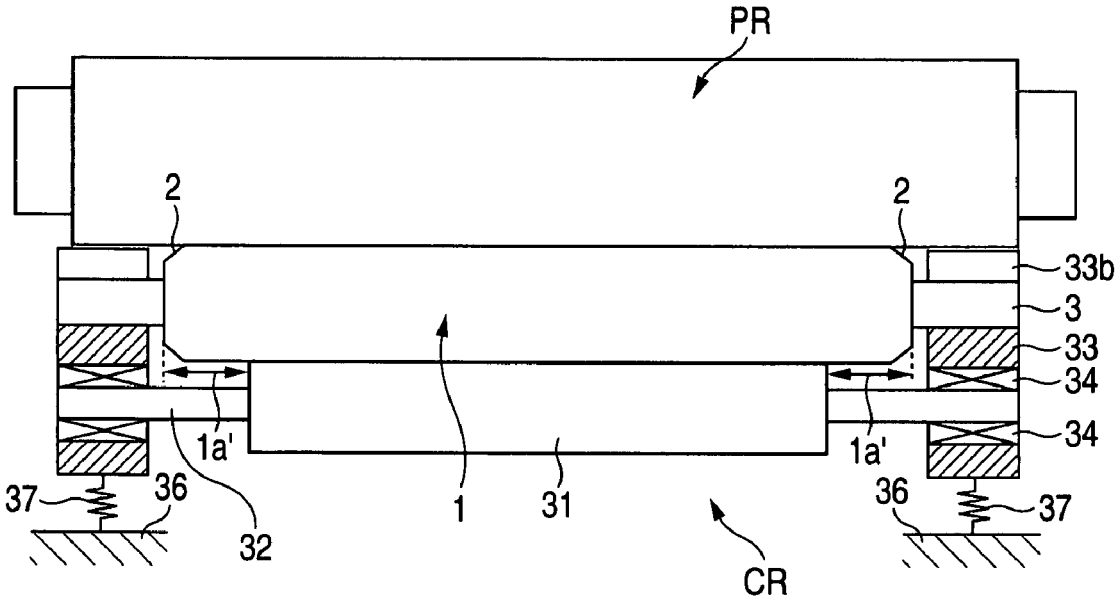
FIG. 9 is a diagram illustrating length relationships among an image carrier, a charger, and a charger cleaning member of the image forming apparatus of Example 6 of the invention.

FIG. 9 is a diagram illustrating length relationships among an image carrier, a charger, and a charger cleaning member of the image forming apparatus of Example 6 of the invention.

Figure 10:
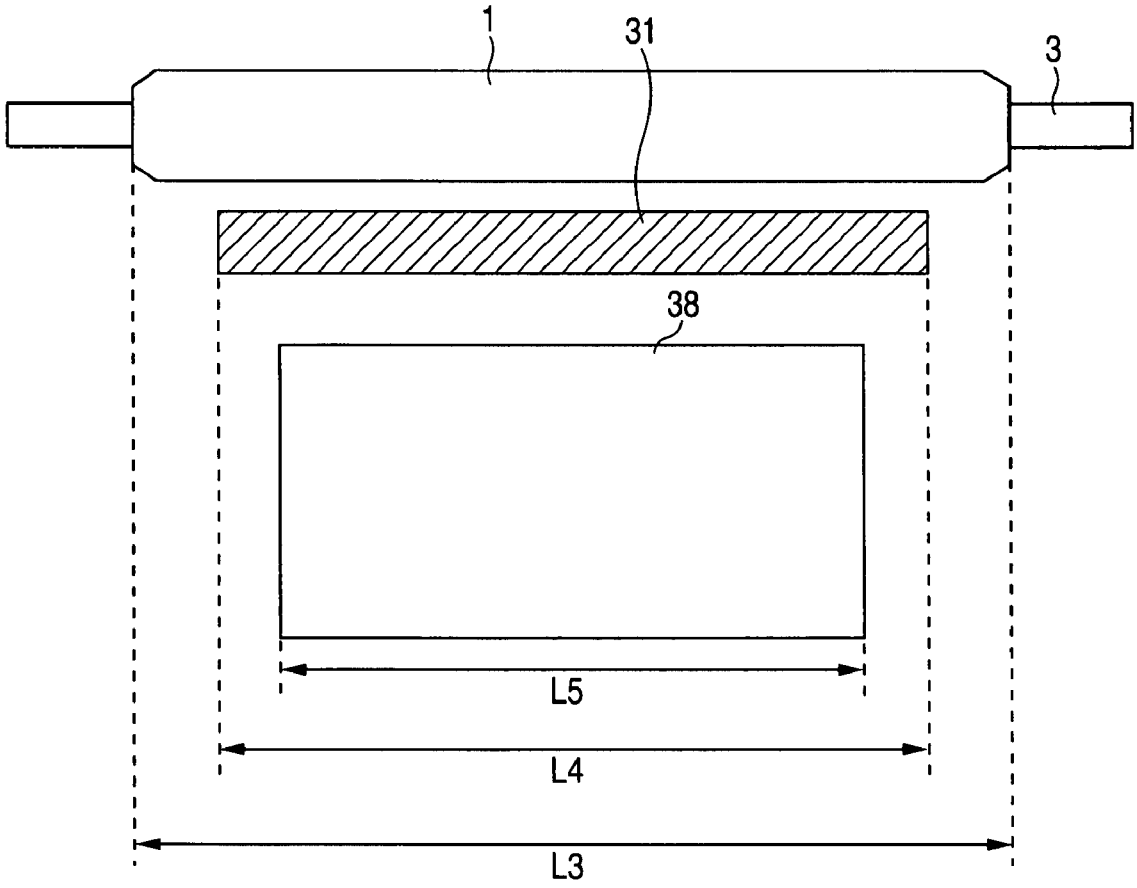
FIG. 10 is a diagram illustrating relationships among a charging region, a charger cleaning region, and an image forming region of the image forming apparatus of Example 6 of the invention.

FIG. 10 is a diagram illustrating relationships among a charging region, a charger cleaning region, and an image forming region of the image forming apparatus of Example 6 of the invention.

Referring to FIGS. 8 and 9, in the image forming apparatus U of Example 6, the charger CRy has the charger cleaning member 31 which is placed on the side of the charging roll 1 opposite to the charging region Q0*y*. The charger cleaning member 31 is formed into a cylinder rotation body, or a so-called roller-like shape. The rotation shaft 32 of the charger cleaning member 31 is supported at both end portions by a pair of shaft support members 33. Each of the shaft support members 33 has: a cleaning-member supporting portion 33*a* which supports the rotation shaft 32 of the charger cleaning member 31 via a bearing 34; and a charging-member supporting portion 33*b* which is formed into a pair of claws, and which rotatably supports the core member 3 serving as the rotation shaft. Coil springs 37 which are examples of an urging member are mounted between the shaft supporting members 33 and a frame 36 of the image forming apparatus U. The coil springs 37 cause the charging roll 1 to be pressed against the image carrier PRy, and the charger cleaning member 31 to be pressed against the charging roll 1. In Example 6, for example, the urging force of the coil springs 37 is set to 7.5 N.

In the charger cleaning member 31 in Example 6, a metal shaft having an outer diameter of 6 mm can be used as the rotation shaft 32. The member can be configured by supporting a brush having a height of 2 mm on the outer circumference of the metal shaft 32. The axial length is set to 300 mm.

In the brush, for example, fibers of polyethylene terephthalate, polypropylene, or nylon and having a thickness of 40 to 50 T can be used. The character "T" indicates grams per 10,000 m, and "50 T" means fibers having a thickness at which the weight of 50 grams per 10,000 m is obtained. In place of the brush, a foam elastic member having a thickness of 2 mm may be used. In this case, for example, urethane foam or melamine foam may be used, and a member having a cell density of, for example, 40 to 120 cells per 25 mm may be used. The cell density means the number of foam holes per 25 mm.

Referring to FIG. 10, in the image forming apparatus of Example 6, the width L3 of the charging region Q0*y* to Q0*k* corresponding to the length of the charging roll 1, the width L4 of the charger cleaning region corresponding to the length of the charger cleaning member 31, and the width L5 of the image forming region 38 where an image is formed by the latent-image forming device ROS are set so as to be L3>L4>L5. For example, the width L3 of the charging region Q0*y* to Q0*k* corresponding to the length of the charging roll 1 is set to 320 mm, and the width L4 of the charger cleaning region corresponding to the length of the charger cleaning member 31 is set to 300 mm corresponding to the middle portion of the charging region. In the charging roll 1 having a length of 320 mm, therefore, non-cleaned regions which are not cleaned by the charger cleaning member 31 having a length of 300 mm, i.e., discharge-inhibitor giving areas 1*a*' are disposed in 10-mm end portions, respectively.

Function of Example 6

In the thus configured image forming apparatus U of Example 6, the discharge inhibitor such as a toner and the like adhering to the image forming region, and a toner and the like scattered and adhering to the outside of the image forming region is removed away by the image-carrier cleaner CLy to CLk, but the discharge inhibitor which has been passed through the image-carrier cleaner CLy to CLk and adhered to the charging roll 1 is removed away by the charger cleaning member 31. In this case, the end portions of the charging roll 1 are not cleaned by the charger cleaning member 31, and the discharge inhibitor adheres or is given to the discharge-inhibitor giving areas 1*a*'. Namely, the resistance of the areas is increased.

Example 7

Next, Example 7 of the invention will be described. In the description of Example 7, the components corresponding to those of Examples 1 and 6 are denoted by the same reference numerals, and their detailed description will be omitted.

Example 7 is configured in the same manner as Examples 1 and 6 except the following points.

Figure 11:
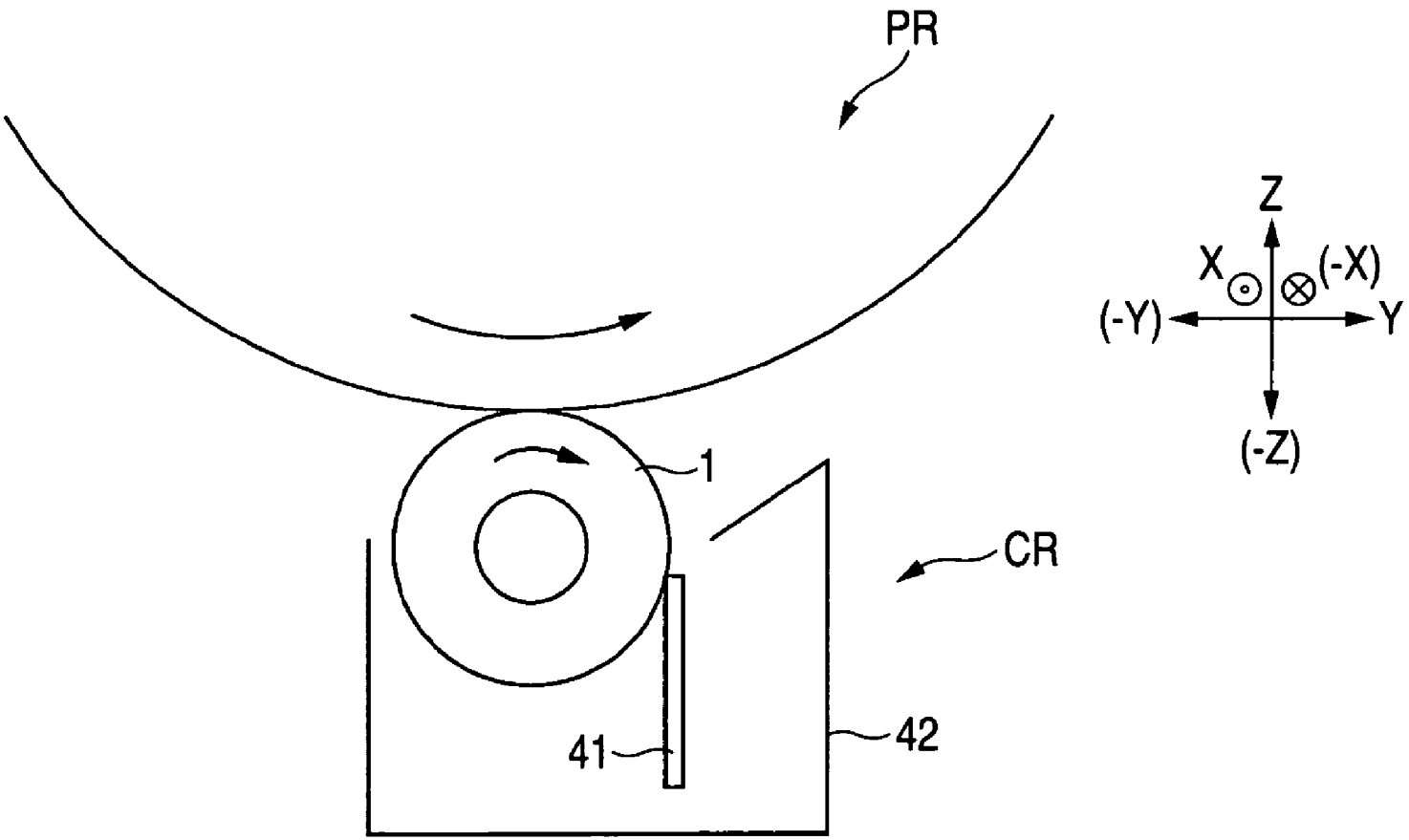
FIG. 11 is a diagram illustrating main portions of a charger portion of the image forming apparatus of Example 7 of the invention.

FIG. 11 is a diagram illustrating main portions of a charger portion of the image forming apparatus of Example 7 of the invention.

Figure 12:
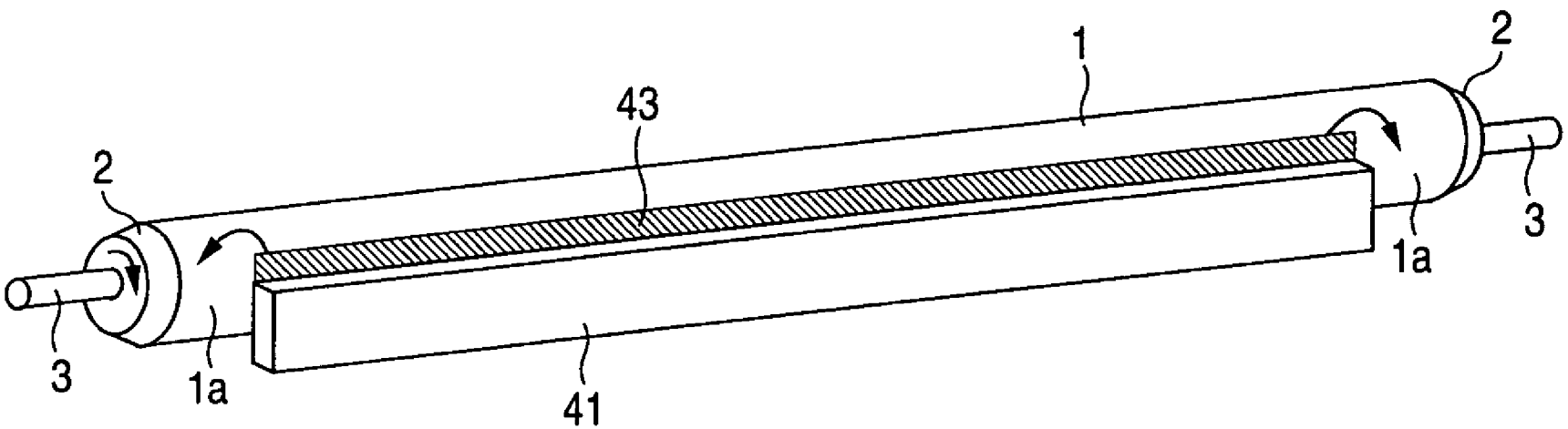
FIG. 12 is a perspective diagram illustrating main portions of a charger and a charger cleaning member in Example 7 of the invention.

FIG. 12 is a perspective diagram illustrating main portions of the charger and the charger cleaning member in Example 7 of the invention.

Referring to FIGS. 11 and 12, in the image forming apparatus U of Example 7, the charger cleaning member 41 is formed into a plate-like shape which is contacted with the surface of the charging roll 1, i.e., a blade-like shape. In the periphery of the charger cleaning member 41, a charger-residual housing container 42 for housing a residual which has been scraped off by the charger cleaning member 41, i.e., a discharge inhibitor 43 is placed.

In the charger CRy to CRk in Example 7, the length of the blade-like charger cleaning member 41 is set to 300 mm, that of the charging roll 1 is set to 320 mm, and the discharge-inhibitor giving areas 1*a* are set in the end portions of the charging roll 1.

Function of Example 7

In the thus configured image forming apparatus U of Example 7, the discharge inhibitor such as a toner adhering to the charging roll 1 is removed away by the blade-like charger cleaning member 41, and recovered into the charger-residual housing container 42. At this time, the discharge-inhibitor giving areas 1*a* are not cleaned by the charger cleaning member 41, and are in the state where the discharge inhibitor is given. In the blade-like charger cleaning member 41, a part of the discharge inhibitor 43 which has been scraped by the rotation of the charging roll 1 is moved so as to be retracted in end portions of the blade toward the outside, i.e., the discharge-inhibitor giving areas 1*a* as shown by the arrows of FIG. 12. In this way, the discharge inhibitor is given to the discharge-inhibitor giving areas 1*a* of the charging roll 1, and the resistance of the end portions of the charging roll 1 is increased.

Example 8

Next, Example 8 of the invention will be described. In the description of Example 8, the components corresponding to those of Example 1 are denoted by the same reference numerals, and their detailed description will be omitted.

Example 8 is configured in the same manner as Example 1 except the following points.

Figure 13:
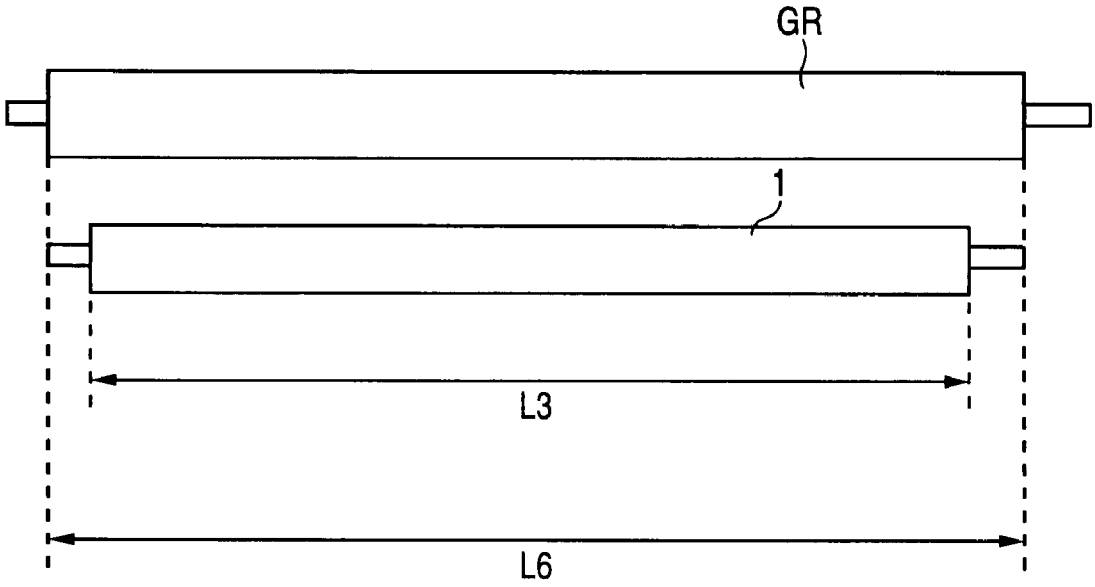
FIG. 13 is a diagram of main portions of a developer and a charger of the image forming apparatus of Example 8 of the invention.

FIG. 13 is a diagram of main portions of a developer and a charger of the image forming apparatus of Example 8 of the invention.

Referring to FIG. 13, in the image forming apparatus U of Example 8, with respect to the length L3 of the charging roll 1, the length L6 of the developing rolls GRy, GRm, GRc, GRk of the developers Gy, Gm, Gc, Gk is set to be L6>L3. In example 8, for example, the length L6 is set to 322 mm, and the length L3 is set to 320 mm.

Function of Example 8

In the thus configured image forming apparatus of Example 8, because of the developing rolls GRy, GRm, GRc, GRk which are longer than the length L3 of the charging roll 1, adhesion of the toner, i.e., toner fogging easily occurs in the range longer than the length of the charging roll 1, in the surfaces of the image carriers PRy to PRk. When such toner fogging occurs, the amount of a toner adhering to the end portions is increased, and, in the end portions, the amount of a toner moving toward the cleaning blade 24 is increased. In the charging roll 1 in Example 8, therefore, the amount of a toner adhering to the end portions of the charging roll 1 is large, and the resistance of the end portions is increased.

Example 9

Next, Example 9 of the invention will be described. In the description of Example 9, the components corresponding to those of Example 1 are denoted by the same reference numerals, and their detailed description will be omitted.

Example 9 is configured in the same manner as Example 1 except the following points.

Figure 14:
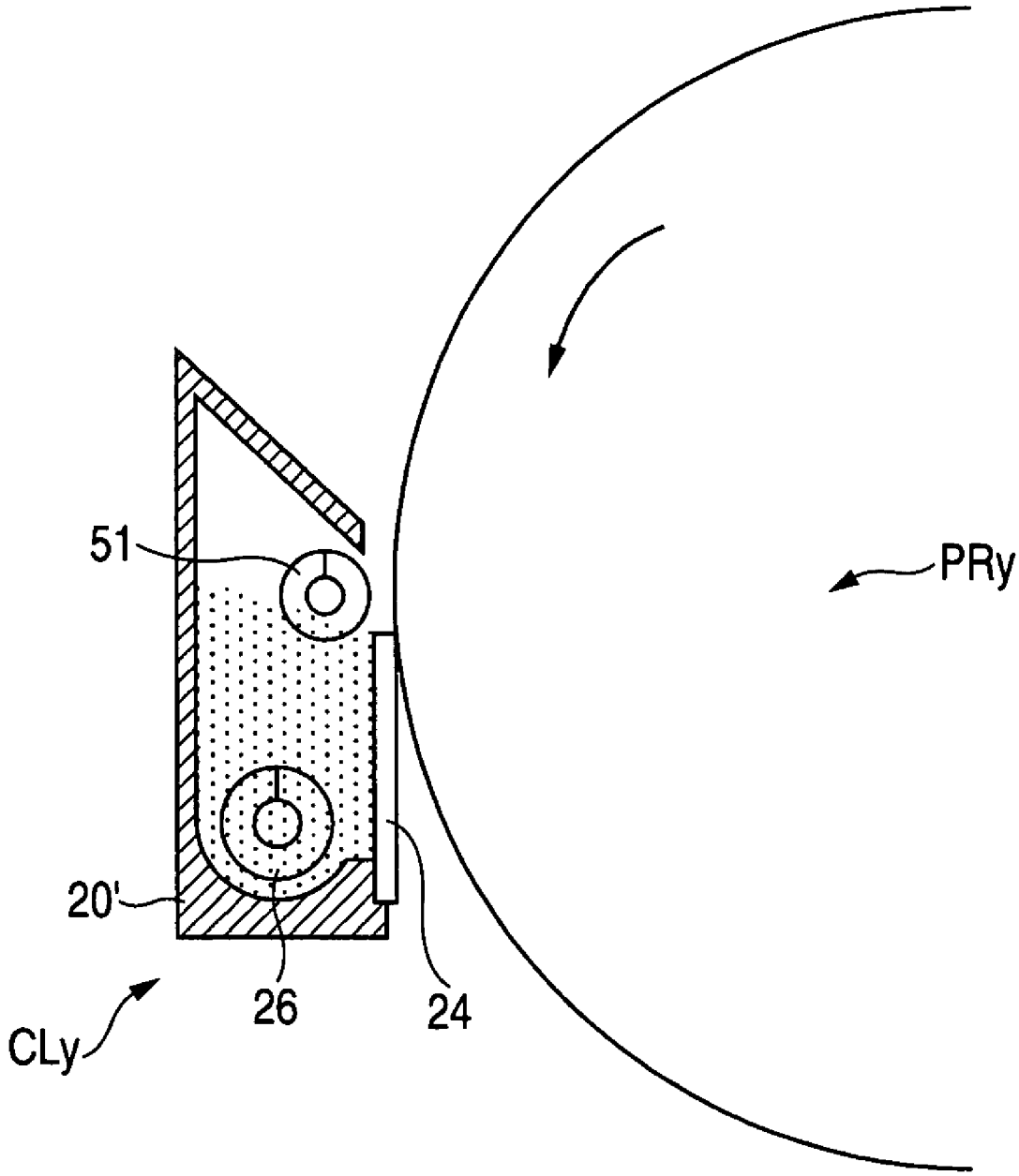
FIG. 14 is a diagram of main portions of an image carrier and an image carrier cleaner of the image forming apparatus of Example 9 of the invention.

FIG. 14 is a diagram of main portions of an image carrier and an image carrier cleaner of the image forming apparatus of Example 9 of the invention.

Figure 15:
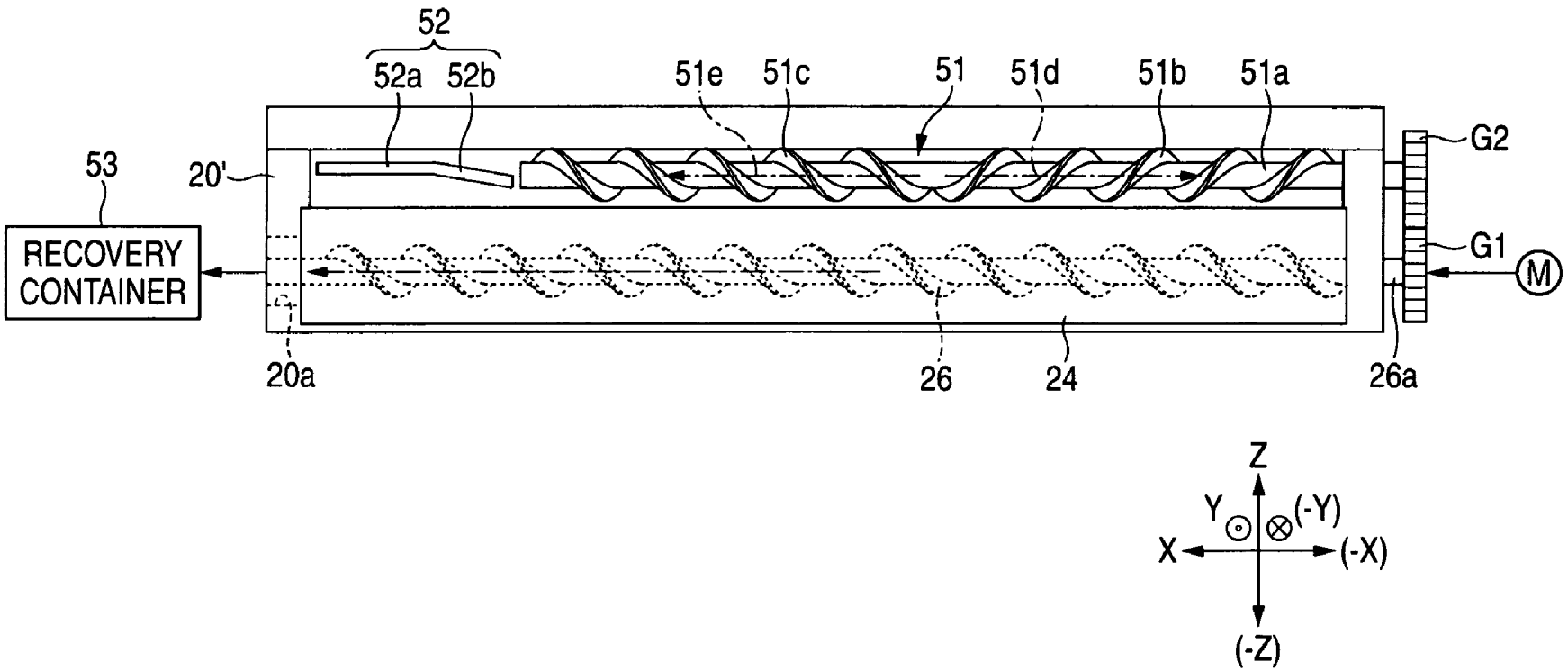
FIG. 15 is a diagram of an image carrier cleaner of the image forming apparatus of Example 9 of the invention.

FIG. 15 is a diagram of the image carrier cleaner of the image forming apparatus of Example 9 of the invention.

Referring to FIGS. 14 and 15, in the image-carrier cleaner CLy to CLk in Example 9, an end-transport auger 51 which is an example of an end-portion transporting member is disposed in place of the cleaning brush 21 in the image-carrier cleaner CLy to CLk in Example 1. A plate-like regulating member 52 is placed in front (the side of +X of FIG. 15) of the end-transport auger 51. The end-transport auger 51 has: a rotation shaft 51*a*; a rearward transport vane 51*b* which is supported by the outer circumference of the rotation shaft 51*a* in the range from a middle portion to a rear portion; and a forward transport vane 51*c* which is supported by the outer circumference of the rotation shaft 51*a* in the range from the middle portion to a front portion.

A rear end portion of the rotation shaft 51*a* of the end-transport auger 51 is rotatably supported by a housing 20', and a gear G2 is fixed to and supported by the rear end. The gear G2 meshes with a gear G1 which is supported by a rotation shaft 26*a* of the waste-toner transport auger 26, and a driving force of a driving system M for the image carrier cleaner is transmitted to the gear G1.

The regulating member 52 has a front horizontal portion 52*a*, and an inclined portion 52*b* which extends obliquely downward from the rear end of the horizontal portion 52*a*. In the image-carrier cleaner CLy to CLk in Example 9, as shown in FIG. 14, the amount of residuals which has been recovered by the cleaning blade 24 and housed in the housing 20' is set so that the height is approximately equal to the height of an upper end portion of the cleaning blade 24.

When rotation is transmitted from the driving system M, the waste-toner transport auger 26 is rotated, and recovery residuals in the housing 20' are transported toward a discharge port 20*a* of the housing 20', and recovered into a recovery container 53. At this time, also the end-transport auger 51 is rotated, so that residuals in an upper side portion of the residuals housed in the housing 20' are transported. The residuals are transported by the vanes 51*b*, 51*c* in the directions of the arrows 51*d*, 51*e*, i.e., toward the axial end portions of the image carrier PRy to PRk. In Example 9, the driving and stoppage of the driving of the driving system M are adjusted so that the recovery amount by the cleaning blade 24 is approximately equal to the discharge amount by the waste-toner transport auger 26, and the amount of residuals in the housing 20' is be approximately equal to the height of an upper end portion of the cleaning blade 24.

Function of Example 9

In the thus configured image forming apparatus of Example 9, the toner and the like adhering to the surface of the image carrier PRy to PRk are recovered by the cleaning blade 24, and housed into the housing 20'. The residuals housed in the housing 20' are transported in accordance with the driving of the waste-toner transport auger 26 to be recovered into the recovery container 53, and residuals in an upper portion are transported toward the front and read end sides by the end-transport auger 51. The height of the recovered residuals in the housing 20' is approximately equal to the height of the cleaning blade 24. In front and read end portions, as more advancing toward end portions, the amount of residuals is made larger by residuals scraped by the cleaning blade 24 and the developing agent transported from the upstream side. Therefore, the residuals exceeds the height of the cleaning blade 24 so that they are easily returned to the image carrier PRy to PRk. In this case, in the front side which is on the downstream side of the transportation direction of the waste-toner transport auger 26, there are residuals transported from the upstream side by the waste-toner transport auger 26 in addition to those scraped by the cleaning blade 24 and transported from the upstream side by the end-transport auger 51, and there is a possibility that the total amount is large. In order to prevent the residuals from being excessively increased, the height is regulated by the regulating member 52. In the regulating member 52, the vertical height of the horizontal portion 52*a* on one end side is higher than the inclined portion 52*b* on the inner side, and hence a large amount of residuals can be easily returned to the end side of the image carrier PRy to PRk. The residuals which are returned to the end portions of the image carrier PRy to PRk by the end-transport auger 51 and the regulating member 52 are larger in amount than that returned to the middle portion, and hence easily passed through the cleaning blade 24. The residuals which have been passed adheres to the end portions of the charging roll 1, and the resistance of the end portions of the charging roll 1 is increased.

The residual in the hosing 20' may be stored by not driving the waste-toner transport auger 26 until a predetermined amount of the residual is stored in the hosing 20'. Alternatively, for example, this may be realized by previous filling at shipment of the image forming apparatus U from the factory, or an operation in which, during installation of the image forming apparatus U, image formation is performed on the image carriers PRy to PRk without transporting the recording sheet S, and all toners of the formed images are recovered by the image-carrier cleaners CLy to CLk. In the case of previous filling or the like, even immediately after installation, the discharge inhibitor is given to the end portions of the charging roll 1.

Experimental Example

Figure 16A:
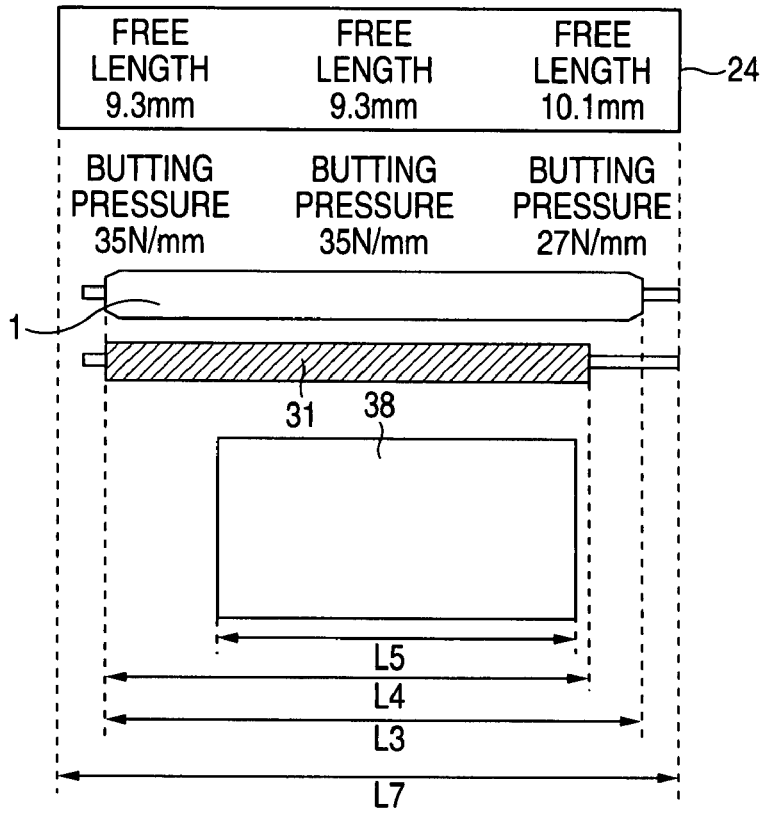
FIGS. 16A, 16B and 16C are diagrams illustrating experimental conditions on an experimental example of the invention.
Figure 16B:
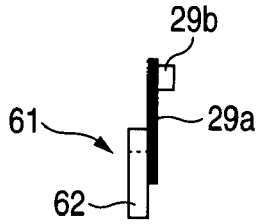
Figure 16C:
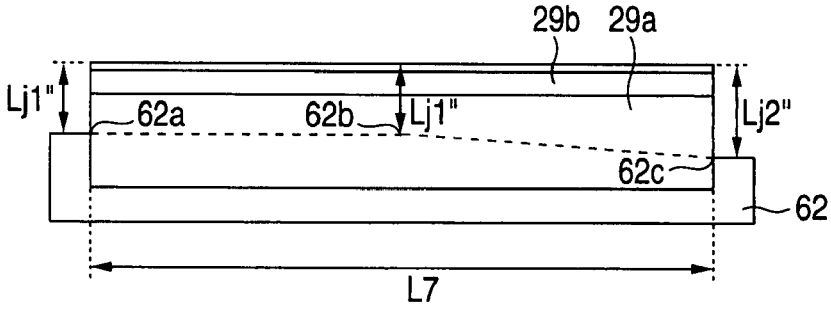

FIGS. 16A, 16B and 16C are diagrams illustrating experimental conditions on an experimental example of the invention, FIG. 16A is a diagram illustrating length relationships among components, FIG. 16B is a side view of an image-carrier cleaning member used in the experimental example, and FIG. 16C is a front view of the image-carrier cleaning member used in the experimental example.

Next, in order to check the effects of the invention, the following experiments are conducted. Referring to FIGS. 16A, 16B and 16C, in an image forming apparatus including the image-carrier cleaners CLy to CLk shown in FIGS. 16B and 16C, and the charger cleaning member 31 shown in Example 6, experiments for checking the effect of suppressing end local wear are conducted. Referring to FIGS. 16B and 16C, the image-carrier cleaning member 61 used in the experimental example has: the urging member 29*a* and contact member 29*b* which are exemplified in Examples 3 and 4; and a support member 62 which supports a basal end portion of the urging member 29*a*.

In order to check the difference of effects in one and other end sides, the support member 62 has a shape different from the support member 28, 28" described in Examples 3 and 4. In the support member 62, namely, a length Lj1" extending from one end portion 62*a* (the left side of FIGS. 16A and 16C) to a middle portion 62*b* on the side of the image carrier PRy to PRk, i.e., the free length Lj1" of the urging member 29*a* is set to 9.3 mm. As more advancing from the middle portion 62*b* toward another end portion 62*c* (the right side of FIGS. 16A and 16C), the length extending toward the image carrier PRy to PRk is further shortened. In the other end portion 62*c*, a length Lj2" extending toward the image carrier PRy to PRk, i.e., the free length Lj2" of the urging member 29*a* is set to 10.1 mm.

A sponge roll is used as the charger cleaning member 31. A voltage in which an AC voltage having an amplitude of 1,700 V and a frequency of 1,306 Hz is superimposed on a DC voltage of $V_{DC}$=−750 V is used as a charging voltage on the charging roll 1. The length L7 of the contact member 29*b* of the image-carrier cleaning member 61, the length L3 of the charging roll 1, the length L4 of the charger cleaning member 31, and the length L5 of the image forming region 38 are set to be L7>L3>L4>L5 as shown in FIGS. 16A, 16B and 16C. In order to check the difference of effects in one and other end sides, the placement position of the charger cleaning member 31 is differently set. Namely, the position is set so that, in the one end side (the left side of FIGS. 16A and 16C), also the end portion of the charging roll 1 is cleaned by the charger cleaning member 31, and, in the other end side (the right side of FIGS. 16A and 16C), the end portion of the charging roll 1 is not cleaned by the charger cleaning member 31.

The biting amount in the middle portion of the cleaning blade 24 is set to 1.2 mm, and the contact angle of the cleaning blade 24 to the image carrier PRy to PRk is set to 27 degrees. In this case, the actual contact angle between the contact member 29*b* and the image carrier PRy to PRk due to elastic deformation of the urging member 29*a*, or the so-called working angle is 13 degrees. In this case, the contact pressure of the contact member 29*b* with respect to the image carrier PRy to PRk is set to 35 mN/mm in the one end portion 62*a* and the middle portion 62*b*, and to 27 mN/mm in the other end portion 62*c*.

As in Example 9, before start of the experiment, a predetermined amount of toner is filled in the hosing 20' of each of the image-carrier cleaners CLy to CLk. As the image forming apparatus U, DCCa450 manufactured by Fuji Xerox Co., Ltd is used. Under high-temperature and high-humidity environments of the temperature of 28° C. and the humidity of 85%, at five sheets per one image forming operation, i.e., one job, a durability test of 200,000 sheets (A4 longitudinal) is executed.

After printing of 200,000 sheets, wear of the image carriers PRy to PRk is observed. As a result, in one end side, local wear is observed in the vicinity of the end portion, and the wear penetrates the surface protective layer of 7.5 μm and reaches the charge transporting layer. By contrast, in the other end side, local wear is not observed, and the effect of suppressing wear of the image carriers PRy to PRk due to end discharging of the charging roll 1 is observed.

(Modifications)

Although, in the above, the examples of the invention have been described in detail, the invention is not restricted to the examples. Various modifications are enabled within the scope of the spirit of the invention set forth in the claims. Modifications (H01) to (H07) of the invention will be exemplified.

(H01) In the examples, a copier is exemplified as the image forming apparatus. The invention is not restricted to this.

The image forming apparatus may be configured as a facsimile apparatus, a printer, or a multifunction machine having all or plural functions of such apparatuses.

(H02) In the examples, specific values and materials of the components may be arbitrarily changed in accordance with the design, the specification, and the like.

(H03) In the examples, the configurations of all or a part of the examples may be combined with one another, whereby the effect of increasing the resistance of the charging roll is enhanced, or an excessive effect of increasing the resistance is moderated.

(H04) In the examples, the image-carrier cleaners CLy to CLk using the cleaning brush 21 have been exemplified. The invention is not restricted to this. An arbitrary image-carrier cleaning member such as a cleaning roll using nonwoven fabric or the like may be employed. A cleaning roll in which nonwoven fabric using conductive fibers, or nonwoven fabric using insulative fibers is used may be employed. In the case where conductive nonwoven fabric is used, a recovery roll for moving a toner from the cleaning roll, a scraper, and the like may be placed. In a single cleaning roll of insulative nonwoven, the toner component may be held and slidingly rubbed by the minute and porous structure of the nonwoven fabric.

(H05) In the examples, the roll-like charging roll has been exemplified as the charging member. The invention is not restricted to this. The invention may be applied also to a charging member having an arbitrary shape such as a belt-like shape, a blade-like shape, and a brush-like shape. The charging roll is not restricted to the case where it is driven by means of contact. The invention may be applied also to a configuration where the charging roll is driven through a minute gap.

(H06) In the examples, the image carriers PRy to PRk are arranged in the sequence of Y, M, C, and K from the upstream side in the rotation direction of the intermediate transfer belt B. The invention is not restricted to this. The arrangement sequence may be arbitrarily changed. A configuration where the intermediate transfer belt B is not used, and toner images are directly transferred to a medium from the image carriers PRy to PRk, or that where an intermediate transfer drum is used may be employed. The number of the image carriers PRy to PRk is not restricted to four, or the number of colors is not restricted to four. Three colors, or five or more colors may be employed.

(H07) In the examples, the case where the toner, paper dust, discharge products, and the like are used as a high-resistance agent, and these are used also as a discharge inhibitor has been exemplified. The invention is not restricted to this. A dedicated device which supplies a discharge inhibitor for suppressing discharge in end portions of the charging member may be disposed, or a discharge inhibitor may be previously applied. In this case, a useful discharge inhibitor is not restricted to powder, but may be a liquid or an applied solid.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image carrier that rotates;

a charging member that is provided opposingly to the image carrier, and that charges a surface of the image carrier in a condition where the charging member is in contact with the surface of the image carrier; and a discharge inhibitor that suppresses a discharge in an axial end portion of a contacting zone where the charging member is in contact with the surface of the image carrier, the discharge inhibitor being interposed in a portion where the charging member is opposed to the image carrier, wherein the discharge inhibitor is powder.

2. The image forming apparatus according to claim 1, wherein the discharge inhibitor is configured by a toner or an external additive that is externally added to the toner.

3. The image forming apparatus according to claim 1, wherein a charger cleaning member is provided opposingly to and contactingly with the charging member, and a length of a contacting portion in a rotation axis direction is shorter than a charging region of the charging member.

4. The image forming apparatus according to claim 3, wherein the charger cleaning member is configured by a plate-like member.

5. The image forming apparatus according to claim 1, wherein the apparatus comprises a developing-agent carrier that is provided opposingly to the image carrier, that holds a developing agent for developing an electrostatic latent image on the surface of the image carrier, and that is longer in axial length than the charging member.

6. An image forming apparatus comprising:

an image carrier that rotates;

a charging member that is provided opposingly to the image carrier, and that charges a surface of the image carrier;

a discharge inhibitor that suppresses a discharge in an axial end portion, the discharge inhibitor being interposed in a portion where the charging member is opposed to the image carrier; and an image-carrier cleaning member that is provided on an upstream side of the charging member in a rotation direction of the image carrier, that is contacted with the surface of the image carrier to clean the surface, and that allows the discharge inhibitor configured by a residue on the surface of the image carrier to pass through both axial end portions.

7. The image forming apparatus according to claim 6, wherein the discharge inhibitor is configured by a toner or an external additive that is externally added to the toner.

8. The image forming apparatus according to claim 6, wherein the image-carrier cleaning member is a plate-like member in which a tip end is contacted with the surface of the image carrier, and, in a length extending toward the surface of the image carrier, the both end portions are shorter than an axial middle portion.

9. The image forming apparatus according to claim 6, wherein the image-carrier cleaning member comprises:

a plate-like member in which a tip end is contacted with the surface of the image carrier;

and a support member that supports a basal end portion of the plate-like member, and, in a free length that is a length from a tip end of the support member on a side of the surface of the image carrier to a tip end of the plate-like member, the both end portions are longer than an axial middle portion of the image carrier.

10. The image forming apparatus according to claim 9, wherein, in a length of the support member extending toward the surface of the image carrier, the both end portions are shorter than the middle portion.

11. The image forming apparatus according to claim 10, wherein a flat portion in which the length extending toward the surface of the image carrier is uniform is formed in the middle portion of the support member.

12. The image forming apparatus according to claim 6, wherein the image-carrier cleaning member comprises:

a contact member in which a tip end is contacted with the surface of the image carrier;

an urging member in which a tip end portion supports the contact member, and which generates an urging force of urging the contact member against the surface of the image carrier; and a support member that supports a basal end portion of the urging member, and, in a free length which is a length from a tip end of the support member on a side of the surface of the image carrier to a tip end of the urging member, the both end portions are longer than an axial middle portion of the image carrier.

13. The image forming apparatus according to claim 6, wherein the image-carrier cleaning member is a plate-like member in which a tip end is contacted with the surface of the image carrier, and, in a thickness of the plate-like member, both end portions are smaller than an axial middle portion.

14. An image forming apparatus, comprising:

an image carrier that rotates;

a charging member that is provided opposingly to the image carrier, and that charges a surface of the image carrier; and a discharge inhibitor that suppresses a discharge in an axial end portion, the discharge inhibitor being interposed in a portion where the charging member is opposed to the image carrier, wherein the apparatus comprises an image-carrier cleaner having: an image-carrier cleaning member that is provided on an upstream side of the charging member in a rotation direction of the image carrier, and that is contacted with the surface of the image carrier to clean the surface; a cleaning container that houses a residual recovered by the image-carrier cleaning member; a residual-transporting member that transports the residual housed in the cleaning container to a recovery container; and an end-portion transporting member that transports the residual to rotation axial end portions of the image carrier.

15. The image forming apparatus according to claim 14, wherein the apparatus further comprises a regulating member that is disposed in an end portion of the residual-transporting member on a downstream side of a transportation direction, and that regulates a movement of the developing agent from the cleaning container to the image carrier.

16. The image forming apparatus according to claim 14, wherein, when the image forming apparatus is used, the cleaning container houses the developing agent.

17. A charger comprising a charging member which is provided opposingly to an image carrier that rotates, which charges a surface of the image carrier in a condition where the charging member is in contact with the surface of the image carrier, and in which a discharge inhibitor is given to surfaces of both end portions with respect to a rotation axis direction of the image carrier, wherein the discharge inhibitor suppresses a discharge in an axial end portion of a contacting zone where the charging member is in contact with the surface of the image carrier, and the discharge inhibitor is powder.

18. The charger according to claim 17, wherein the discharge inhibitor is configured by a toner or an external additive that is externally added to the toner.

19. An image carrier unit comprising:

an image carrier that rotates;

a charging member that is provided opposingly to the image carrier, and that charges a surface of the image carrier in a condition where the charging member is in contact with the surface of the image carrier; and a discharge inhibitor that suppresses a discharge in an axial end portion of a contacting zone where the charging member is in contact with the surface of the image carrier is interposed in a portion where the charging member is opposed to the image carrier, wherein the discharge inhibitor is powder.

* * * * *